United States Patent [19]

Buchman

[11] 4,067,079

[45] Jan. 10, 1978

[54] PATIENT SHIFTING AID AND METHOD OF USING SAME

[76] Inventor: Ernest C. Buchman, 13105 Knollcrest, Houston, Tex. 77015

[21] Appl. No.: 674,042

[22] Filed: Apr. 5, 1976

[51] Int. Cl.[2] ..... A61G 1/02; A47B 83/04

[52] U.S. Cl. ..... 5/81 R; 5/82 R; 5/92

[58] Field of Search ..... 5/81 R, 81 B, 82 R, 5/86, 92

[56] References Cited

U.S. PATENT DOCUMENTS

| | | | |
|---|---|---|---|
| 2,528,048 | 10/1950 | Gilleland | 5/81 B |
| 3,304,116 | 2/1967 | Stryker | 5/81 R |
| 3,329,978 | 7/1967 | Porter et al. | 5/81 R |
| 3,737,923 | 6/1973 | Prolo | 5/92 |
| 3,962,736 | 6/1976 | Fedele | 5/92 |
| 4,012,799 | 3/1977 | Rutherfold | 5/81 R |

*Primary Examiner*—Casmir A. Nunberg

*Attorney, Agent, or Firm*—Pravel, Wilson & Gambrell

[57] ABSTRACT

A new and improved patient shifting aid and method of using same for assistance in transferring of reclining patients normally unable to propel themselves between patient supports, for example, a stretcher and bed. The patient is essentially placed on a flexible plastic shifting slab having a low friction coefficient for relatively easy sliding and minimizing the direct application to the patient of any shifting force, as well as easily enabling sliding the shifting slab under a patient. While the plastic slab is flexible, the slab is strong enough to enable normal lifting of a patient by two or more persons. In addition, patient X-rays may be taken through the shifting slab further reducing patient handling.

1 Claim, 7 Drawing Figures

PATIENT SHIFTING AID AND METHOD OF USING SAME

BACKGROUND OF THE INVENTION

This invention relates to the field of devices for assisting the transfer of patients unable to move themselves.

It has been the usual practice to shift a patient, for example, between a transporting stretcher and operating table by two or more attendants partially lifting the patient and sliding the patient from one support to another. Some injuries, notably neck and back injuries, can be aggravated during such shifting. Also, the obtaining of X-rays to determine the extent of such injuries necessitates additional shifting of the patient with increased risk of injury aggravation by such movement.

In the past, ambulances have been equipped with wooden "back boards" for neck and back injuries to which the injured person is strapped to prevent undesired movement that may aggravate the injury. Such "back boards" are in reality a form of a stretcher and not an attendant aid for shifting an injured patient from the ground to a stretcher or between a stretcher and the operating table. Also, such wooden "back boards" were relatively expensive and unwieldy and, significantly, of no benefit in transporting a patient from a horizontal stretcher to an operating table.

SUMMARY OF THE INVENTION

A patient shifting aid in the form of a flexible plastic slab providing a support surface for the patient and having suitable grips for the attendant or attendants effecting the patient shifting. The slab is perferably formed of polyethylene plastic to provide a smooth sliding surface for reducing friction and thereby reducing the effort and often the number of attendants necessary to shift the patient and minimizing the shifting force that the attendants may apply directly to the patient's body which reduces the risk of aggravation of some types of injuries. In addition, patient X-rays may be taken through the plastic slab to further reduce the handling of seriously injured patients and the attendant risk of injury aggravation.

DESCRIPTION OF THE PREFERRED EMBODIMENTS

Figure 1:
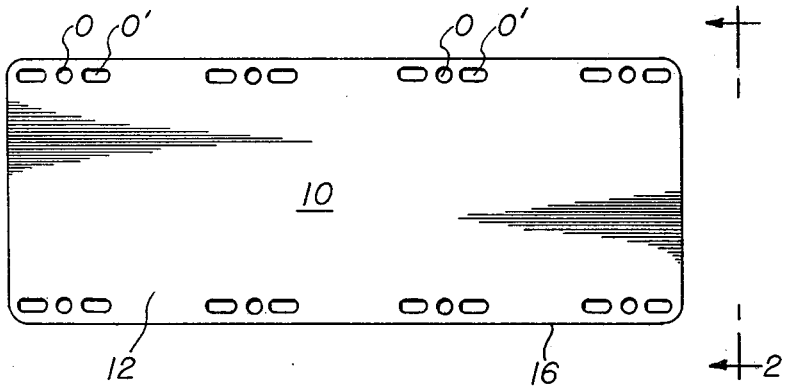
FIG. 1 is a top view of the patient shifting aid of the present invention.
Figure 2:
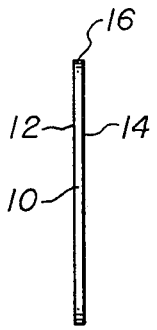
FIG. 2 is a view taken along line 2—2 of FIG. 1.

The patient shifting aid of the present invention is illustrated in FIGS. 1 and 2 while its use in shifting injured persons is illustrated in FIGS. 3, 4, 5, 6 and 7. Essentially, the patient shifting aid of the present invention is employed in moving patients that are unable to move by their own efforts for any reason between various patient supports.

As illustrated in FIGS. 1 and 2, the patient shifting aid of the present invention is essentially formed of a flexible plank or slab 10 of plastic material. The slab 10 is made of sufficient thickness to support the weight of a patient placed thereon while retaining some degree of flexibility of the slab 10. The slab 10 preferably forms a rectangular patient supporting surface 12 having rounded or radiused corners upon which the patient may be placed and a companion oppositely facing rectangular sliding surface 14 and which rests on a patient support device, as will be described hereinafter, for sliding along the patient support device as desired. Both the patient support surface 12 and the sliding surface 14 are made as smooth as possible in order to reduce the friction coefficient between the slab 10 and the patient and the patient support device. Preferably, the slab 10 is formed of polyethylene plastic and the surfaces 12 and 14 are provided with a slick surface to minimize friction. In addition, it is to be understood that while the patient support surface has been identified 12 and the surface 14 identified as the sliding surface, the function of the surfaces could be reversed and the surface 14 used to support the patient due to the symmetry of the slab 10 providing this reversible capability.

The generally rectangular patient support surfaces 12 and 14 define the thickness periphery 16 of the slab 10. Preferably the slab width is in the range of 20 to 21 inches and with a slab length range of 40 to 48 inches. Suitable thicknesses of the flexible slab 10 range between one-quarter of an inch and one-eighth of an inch.

Figure 6:
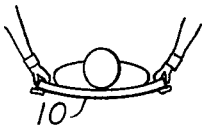
FIG. 6 is an end view of the shifting aid when lifting a patient.
Figure 7:
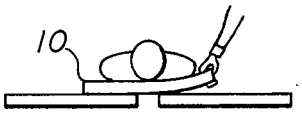
FIG. 7 is an end view of the shifting aid partially flexed to accommodate the gripping hands of the attendant during sliding.

Disposed adjacent the slab surface periphery 16 are a plurality of openings O and O′ formed in the slab 10 to provide means for gripping the slab 10 by attendants to effect desired lifting and sliding movement of the slab 10. The openings O are essentially 1 inch in diameter for a single attendant's fingers while the openings designated O′ are approximately 1 inch by 4 inch generally rectangular openings having round corners for four attendant's fingers. Preferably, the openings O and O′ are disposed inwardly from the periphery 16 a distance greater than the thickness T of the slab 10. It is to be understood that the slab 10 is to be sufficiently flexible that the portion of the slab 10 adjacent the openings O and O′ employed to effect shifting are bendable to provide clearance for the hands of the person effecting the shifting and which flexibility and clearance is illustrated in FIG. 7. However, it is to be understood that the thickness T is sufficient that when the slab is held on both sides, the slab 10 is sufficiently strong to support a patient during lifting as is illustrated in FIG. 6.

Figure 3:
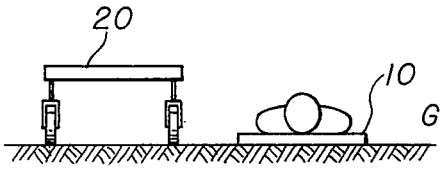
FIG. 3 is an end view of one method of using the patient shifting aid.
Figure 4:
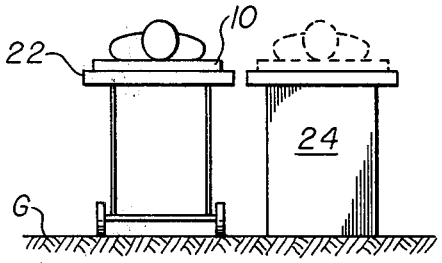
FIG. 4 is an end view of another method of using the patient shifting aid.
Figure 5:
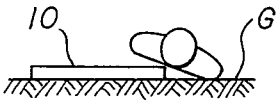
FIG. 5 is an end view of a method of placing a less seriously injured patient on the patient shifting aid.

The present invention is employed in a assisting the shifting of a patient from one patient support to another. By patient support it should be understood that such patient support may be the ground or earth surface G in case of an accident victim as illustrated in FIG. 3 that is being moved by lifting and sliding to the ambulance stretcher device 20 which is elevated above the ground G. In FIG. 4, the patient is being shifted from the portable hospital stretcher device 22 to a fixed hospital support device 24 where it is only necessary to slide the patient from the stretcher 22 to the fixed support device 24. It is to be understood that the fixed support device 24 can be either an operating table or a patient support for taking of X-rays. It is to be further understood that the slab 10 may be employed in moving a patient from the fixed hospital support 24 to the portable stretcher 22. It is to be further understood that the slab 10 of the present invention may be used whenever it is desirable to shift a seriously injured patient from one position to another and the above examples are by way of illustration and not of limitation.

While the low coefficient friction of the surfaces 12 and 14 enable the sliding of the slab 10 under a patient without the need to elevate the patient, the positioning of the patient on the slab 10 may be expedited by the patient, either being rolled by attendants or under his own power rolling over on one shoulder and enabling the slab 10 to be positioned substantially in a location where the patient will roll back onto the patient support surface 12. This enables a single attendant to effect shifting from one patient support device to another patient support device when only sliding movement is involved. If lifting of the patient as well as sliding is needed, two or more attendants will be required, as illustrated in FIG. 6, when lifting the patient from the ground in FIG. 3 onto the ambulance stretcher 20. In addition, patient x-rays may be taken through the plastic slab to further reduce the handling of seriously injured patients and the attendant risk of injury aggravation.

The foregoing disclosure and description of the invention are illustrative and explanatory thereof, and various changes in the size, shape and materials as well as in the details of the illustrated construction may be made without departing from the spirit of the invention.

I claim:

1. A patient shifting aid comprising:

a plastic slab having rounded corners forming a rectangular support surface upon which a patient is adapted to be placed and having sufficient thickness to support the weight of a patient placed thereon while enabling the obtaining of x-rays through the plastic slab to determine the extent of patient injury without the necessity of additional shifting of the patient;

a plurality of openings in said slab and disposed adjacent the periphery of said support surface providing means for gripping the plastic slab to effect sliding movement of the plastic slab and the patient support thereon;

said plurality of openings comprising generally rectangular openings having rounded corners and rounded openings for grasping the slab for moving a patient;

said openings being disposed inwardly from the periphery of the slab a greater distance than the thickness of the slab;

said slab having a sliding surface opposite said support surface which frictionally engages the support for the patient shifting and, said sliding surface and said support surface being formed smoothly to minimize frictional resistance to sliding movement; and said slab having sufficient flexibility to allow bending to provide clearance for the hands of a person effecting shifting of a patient.

* * * * *